US006793860B2

(12) United States Patent
Xing et al.

(10) Patent No.: US 6,793,860 B2
(45) Date of Patent: Sep. 21, 2004

(54) METHODS FOR PRODUCING AQUEOUS INK-JET RECORDING MEDIA USING HOT-MELT EXTRUDABLE COMPOSITIONS AND MEDIA PRODUCED THEREFROM

(75) Inventors: Linlin Xing, West Warwick, RI (US); William M. Risen, Jr., Rumford, RI (US); Jay C. Song, Coventry, RI (US); Steven J. Sargeant, East Greenwich, RI (US)

(73) Assignee: Arkwright Incorporated, Fiskeville, RI (US)

( * ) Notice: Subject to any disclaimer, the term of this patent is extended or adjusted under 35 U.S.C. 154(b) by 79 days.

(21) Appl. No.: 09/754,370

(22) Filed: Jan. 5, 2001

(65) Prior Publication Data

US 2002/0001697 A1 Jan. 3, 2002

Related U.S. Application Data

(60) Provisional application No. 60/174,602, filed on Jan. 5, 2000.

(51) Int. Cl.[7] ..... B41M 5/00
(52) U.S. Cl. ..... 264/176.1; 428/32.24
(58) Field of Search ..... 264/176.1; 428/32.24, 428/195; 347/105

(56) References Cited

U.S. PATENT DOCUMENTS

| | | | | |
|---|---|---|---|---|
| 4,301,195 A | | 11/1981 | Mercer et al. | 427/261 |
| 4,436,789 A | | 3/1984 | Davis et al. | 428/537.5 |
| 5,051,222 A | | 9/1991 | Marten et al. | 264/13 |
| 5,206,278 A | | 4/1993 | Famili et al. | 524/377 |
| 5,264,275 A | | 11/1993 | Misuda et al. | 428/304.4 |
| 5,270,103 A | | 12/1993 | Oliver et al. | 428/219 |
| 5,349,000 A | * | 9/1994 | Robeson et al. | 524/388 |
| 5,350,476 A | | 9/1994 | Edwards | 156/244.11 |
| 5,369,168 A | | 11/1994 | Famili et al. | 525/57 |
| 5,372,884 A | | 12/1994 | Abe et al. | 428/331 |
| 5,387,630 A | | 2/1995 | Edwards et al. | 524/210 |
| 5,389,723 A | | 2/1995 | Iqbal et al. | 525/57 |
| 5,472,789 A | | 12/1995 | Iqbal et al. | 428/483 |
| 5,512,370 A | | 4/1996 | Edwards et al. | 428/373 |
| 5,518,821 A | | 5/1996 | Sakaki et al. | 428/500 |
| 5,521,002 A | | 5/1996 | Sneed | 428/331 |
| 5,624,482 A | | 4/1997 | Kijimuta et al. | 106/31.37 |
| 5,662,997 A | | 9/1997 | Onishi et al. | 428/331 |
| 5,665,504 A | | 9/1997 | Malhotra | 430/97 |
| 5,677,067 A | | 10/1997 | Kojima et al. | 428/478.2 |
| 5,700,582 A | | 12/1997 | Sargeant et al. | 428/476.6 |
| 5,721,086 A | | 2/1998 | Emslander et al. | 430/126 |
| 5,824,462 A | | 10/1998 | Ashida et al. | 430/531 |
| 5,888,635 A | | 3/1999 | Yang et al. | 428/212 |
| 5,910,359 A | | 6/1999 | Kobayashi et al. | 428/327 |
| 5,928,765 A | | 7/1999 | Malhotra | 428/195 |

FOREIGN PATENT DOCUMENTS

| | | |
|---|---|---|
| EP | 0466057 B1 | 1/1992 |
| EP | 0611804 A1 | 8/1994 |
| EP | 0705172 B1 | 10/1996 |

OTHER PUBLICATIONS

Dragan Djordjevic, 1997 Polymers Laminations & Coatings Conference; "Extusion Coating Today and Tomorrow"; pp. 519–527; (TAPPI Proceedings).

* cited by examiner

*Primary Examiner*—Bruce H. Hess
(74) *Attorney, Agent, or Firm*—Birch, Stewart, Kolasch & Birch, LLP

(57) ABSTRACT

This invention relates to methods for making ink-jet recording media using hot-melt extrudable ink-receptive compositions. The melt-extrudable compositions comprise a blend of a melt-extrudable polyvinyl alcohol composition and poly(2-ethyl-2-oxazoline), a hydrolyzed copolymer of ethylene and vinyl acetate, ethylene/acrylic acid copolymers or ethylene/methacrylic acid copolymers. The invention also encompasses media made by such methods. The media can be used to form high quality, multicolored images.

2 Claims, 2 Drawing Sheets

METHODS FOR PRODUCING AQUEOUS INK-JET RECORDING MEDIA USING HOT-MELT EXTRUDABLE COMPOSITIONS AND MEDIA PRODUCED THEREFROM

CROSS-REFERENCE TO RELATED APPLICATIONS

This application claims priority based on U.S. provisional Application No. 60/174,602 having a filing date of Jan. 5, 2000, the entire contents of which are hereby incorporated by reference.

BACKGROUND OF THE INVENTION

1. Field of the Invention

This invention relates to methods for making media for aqueous ink-jet systems and more particularly to methods for making aqueous ink-jet recording media using hot-melt extrudable ink-receptive compositions. The invention also encompasses media made by such methods.

2. Brief Description of the Related Art

Today, ink-jet printing systems are easier to use and more cost effective than many other printing systems. Ink-jet printing systems are capable of producing high-quality, multicolored images and text for many applications. As a result, ink-jet printing has become more popular in home-office, commercial, textile, and packaging markets, where printing systems are needed. In an ink-jet printing process, liquid ink is squirted through very fine nozzles in a printer, and the resultant ink droplets form an image directly on a recording medium. Typically, the medium comprises a coated film or paper substrate. The quality of the final image or text is largely dependent on the composition of the ink-jet recording medium particularly the coating(s) and substrate.

Most inks used in ink-jet printing devices are aqueous-based inks containing water as their primary component. The aqueous-based inks contain molecular dyes or pigmented colorants. Small amounts of water-miscible solvents, such as glycols and glycol ethers, may also be present in the ink. The intended medium (e.g., paper or film) may be coated with an ink-receptive composition. During printing (imaging), dyes or colorants from the ink penetrate into the ink-receptive coating on the medium. Water and other solvents, if present, evaporate from the printed medium during drying of the medium. By the terms, "ink-receptive coating" (or "ink-receptive composition"), as used herein, it is meant a coating or composition that is capable of receiving (i.e., absorbing) aqueous-based inks. By the term, "aqueous ink-jet recording medium", as used herein, it is meant a medium coated with a composition that is capable of receiving (i.e., absorbing) aqueous-based inks. In order to form high-quality, multicolored images having well-defined resolution and color fidelity, the ink-receptive compositions should have good water absorptivity and be fast drying.

As described in Sargeant et al., U.S. Pat. No. 5,700,582, water-soluble polymers such as poly(vinyl alcohol), cellulose ethers, cellulose esters, poly(vinyl pyrrolidone), gelatins, poly(vinyl acetate) starch, poly(acrylic acids), poly (ethylene oxide), proteins, hydroxypropyl cyclodextrin, poly (2-ethyl-2-oxazoline), alginates, water-soluble gums, and the like are typically used in coating compositions for ink-jet recording media.

However, many water-soluble polymers, such as high molecular weight polyvinyl pyrrolidone, polyvinyl alcohol, natural polymers, and gums, are not suitable for forming hot-melt extrudable compositions, because these materials tend to degrade and decompose at their melting point temperatures.

Hence, current methods for applying water-soluble polymers onto substrates involve dissolving the polymers and other additives in a carrier fluid to form a coating solution. Suitable carrier fluids may comprise organic solvents and/or water. The coating solution is then applied to the substrate by a number of coating methods, such as roller coating, wire-bar coating, dip coating, air-knife coating, curtain coating, slide coating, blade coating, doctor coating, and gravure coating. In some instances, the coating solution may be extruded as a solution using a slot-die.

The major disadvantage with using such conventional coating methods is that an active drying process is required to remove water or solvent from the coating after the coating has been applied to the substrate. Typically, these drying processes use thermal ovens, and there are a limited choice of substrates that can be conveniently dried in such ovens. Many substrates do not have adequate thermal resistance. These drying processes can also place the ink-jet media manufacturer at a competitive cost disadvantage. For example, the speed of a media manufacturing line is limited by the slow drying rate of the coatings. The cost problems are compounded when multiple coatings, requiring multiple drying steps, are applied to the media.

In contrast, hot-melt extrusion coating technology is a high speed process. Extrusion coating technology is conventionally used in the packaging industry. In such coating processes, hot-melt extrudable compositions that do not contain any organic solvents or water, are extruded onto a substrate. By employing various thermoplastic resins, such as polyolefins and ethylene copolymers, extrusion coatings can provide strength, moisture vapor barriers, oxygen barriers, gas permeability, abrasion resistance, flame retardancy, flexibility, and elasticity for packaging and other industrial products.

In the ink-jet printing industry, various film and paper substrates are used to manufacture ink-jet recording media. However, clay-coated papers are typically not preferred, since these papers tend to absorb the aqueous ink vehicle and cockle, i.e., develop an uneven bumpy surface. Rather, polyethylene-coated paper is typically used as the substrate because of its excellent dimensional stability, moisture resistance, surface smoothness, tear resistance and tendency not to cockle. The polyethylene coating acts as a barrier layer and is generally impermeable to the aqueous ink vehicle.

For ink-jet recording media applications, melt-extrusion coating technology may be used to form a polyethylene moisture barrier coating on the base paper. For example, Abe et al., U.S. Pat. No. 5,372,884 discloses an ink-jet recording sheet comprising a transparent or opaque support having an ink-receiving layer. In Example 1, a melt-extrusion coating of a polyethylene resin is described as being applied to both sides of a paper support. Then, the surface of the resin on the front side of the paper is described as then being subjected to corona discharge treatment and coated with a solution of an ink-receiving layer comprising polyvinyl alcohol by means of a curtain coater.

Kojima, U.S. Pat. No. 5,677,067 discloses an inkjet recording sheet comprising an ink-receiving layer on a support material. A polyolefin resin-coated paper is described as one example of a support material. The polyolefin resin-coated paper may be produced by a melt-extrusion coating method.

Kobayashi et al., U.S. Pat. No. 5,910,359 discloses an ink-jet recording sheet having a transparent support and a colorant-receptive layer. Example 16 describes forming a high density polyethylene layer on a base paper by melt extrusion.

Melt extrusion coating techniques may also be used for coating other materials onto substrates.

For example, Emslander et al., U.S. Pat. No. 5,721,086 discloses an image receptor medium comprising a substrate and an image reception layer. The image reception layer comprises an acid or acid/acrylate-modified ethylene vinyl acetate (EVA) polymeric resin. The modified EVA resin is preferably capable of being extruded or co-extruded into a substantially two-dimensional sheet and bonding without delamination to an adjacent substrate layer when the layers are co-extruded or laminated. The material for the substrate layer is preferably a resin capable of being extruded or co-extruded into a substantially two-dimensional film. Suitable materials are described as including polyester, polyolefin, polyamide, polycarbonate, polyurethane, polystyrene, acrylic, and polyvinyl chloride. The medium may have an optional inkjet layer on the outer surface of the image reception layer. In Example 4, a multi-layered film is described as being made using a blown film co-extrusion process. Ink-jet layers comprising bottom and top-coating solutions are described as being solution-coated onto the film using a notchbar coater.

Malhorta, U.S. Pat. No. 5,928,765 discloses recording sheets for use in an electrophotographic printing process (xerography). This process involves generating an electrostatic latent image on an imaging member in an imaging apparatus (e.g., copier machine), developing the latent image with a toner comprising a resin and colorant particles, and transferring and fusing the image to the recording sheet. An electrophotographic printing process is different than an ink-jet printing process. The '765 patent describes coating the substrate on one or both of its surfaces with a coating comprising a binder selected from the group consisting of polyesters, polyvinyl acetals, vinyl alcohol-vinyl acetal copolymers, polycarbonates, and mixtures thereof and certain additives. The '765 patent discloses that the coating composition can be applied to the substrate by any suitable technique including melt extrusion, reverse roll coating, solvent extrusion, and dip coating processes.

It would be desirable to have new methods for making aqueous ink-jet recording media that are capable of forming high-quality, multicolored images with aqueous-based inks from inkjet printers. The present invention provides such methods and the resulting media.

SUMMARY OF THE INVENTION

The present invention relates to methods for producing inkjet recording media.

In one embodiment, a hot-melt extrudable ink-receptive composition comprising a blend of about 50% to about 95% by weight of a melt-extrudable polyvinyl alcohol composition and about 5% to about 50% by weight of a compound selected from the group consisting of poly(2-ethyl-2-oxazoline), a hydrolyzed copolymer of ethylene and vinyl acetate, ethylene/acrylic acid copolymers and ethylene/methacrylic acid copolymers is extruded onto a substrate (e.g., paper or film) to form an ink-jet recording medium having a coated ink-receptive layer. Suitable blends include the following: 1) 50% by weight of poly(2-ethyl-2-oxazoline) and 50% by weight of a melt-extrudable polyvinyl alcohol composition; 2) 10% by weight of a hydrolyzed copolymer of ethylene and vinyl acetate and 90% by weight of a melt-extrudable polyvinyl alcohol composition; 3) 10% by weight of an ethylene/methacrylic acid copolymer and 90% by weight of a melt-extrudable polyvinyl alcohol composition; and 4) 5% by weight of poly(2-ethyl-2-oxazoline), 10% by weight of an ethylene/acrylic acid copolymer, and 85% by weight of a melt-extrudable polyvinyl alcohol composition.

The ink-receptive composition may further comprise a water-soluble polymer or water-insoluble polymer. Examples of suitable water-soluble polymers include polyethylene oxide, polypropylene oxide, polyethylene glycol, polypropylene glycol, polytetrahydrofuran, polyvinylmethylether, and copolymers and mixtures thereof.

Examples of suitable water-insoluble polymers include polyolefins, polyamides, polyesters, polyurethanes, and copolymers and mixtures thereof.

Further, inorganic or organic particulate or additives such as antioxidants, UV stabilizers, antistatic agents, antiblocking agents, foaming agents, plasticizers, and optical brighteners may be added to the ink-receptive composition.

In a second embodiment, a hot-melt extrudable ink-receptive composition comprising a blend of about 50% of poly(2-ethyl-2-oxazoline) and about 50% of a hydrolyzed copolymer of ethylene and vinyl acetate is extruded onto a substrate to form an ink-jet recording medium having a coated ink-receptive layer.

In another embodiment, a first hot-melt extrudable ink-receptive composition comprising a blend of about 50% to about 95% by weight of a melt-extrudable polyvinyl alcohol composition and about 5% to about 50% by weight of a compound selected from the group consisting of poly(2-ethyl-2-oxazoline), a hydrolyzed copolymer of ethylene and vinyl acetate, ethylene/acrylic acid copolymers and ethylene/methacrylic acid copolymers, and a second hot-melt extrudable ink-receptive composition comprising a blend of about 50% to about 95% by weight of a melt-extrudable polyvinyl alcohol composition and about 5% to about 50% by weight of a compound selected from the group consisting of poly(2-ethyl-2-oxazoline), a hydrolyzed copolymer of ethylene and vinyl acetate, ethylene/acrylic acid copolymers and ethylene/methacrylic acid copolymers are co-extruded onto a substrate to form two ink-receptive layers.

This invention also includes a method, wherein the above-described extrudable ink-receptive composition, and a tie composition, and moisture barrier composition are co-extruded onto a substrate to form multiple layers. The extrudable tie composition comprises a polymer selected from the group consisting of polyurethane, ethylene-acrylic acid copolymer, ethylene-methacrylic acid copolymer, ethylene-acrylic acid-methacrylate terpolymer, poly(2-ethyl-2-oxazoline), and copolymers and mixtures thereof. The extrudable moisture barrier composition comprises a polymer selected from the group consisting of polyolefins, ethylene-acrylic acid copolymer, ethylene-acrylate copolymer, and polyester, and copolymers and mixtures thereof The invention also encompasses ink-jet recording media made by the above-described methods.

DETAILED DESCRIPTION OF THE INVENTION

This invention relates to methods for producing ink-jet recording media. The methods involve forming hot-melt extrudable ink-receptive compositions and melt-extruding the compositions onto substrates to form the media.

The ink-jet recording media of this invention can be made using any suitable substrate such as a polymeric film or paper. Examples of suitable polymeric films include films made of polymers selected from the group consisting of polyesters, cellulose esters, polyimides, polystyrenes, polyolefins, poly(vinyl acetates), polycarbonates, and fluoropolymers, and mixtures thereof. Examples of suitable papers include plain papers, clay-coated papers, and resin-coated papers. Preferably, polyester film is used as the film substrate. Clay-coated and polyethylene-coated papers are particularly preferred paper substrates. The thickness of the base substrate may vary, but it is typically in the range of about 1 mil to about 10 mil. The base substrate may be treated with a conventional adhesion-promoting coating as is known in the art.

Figure 1A:
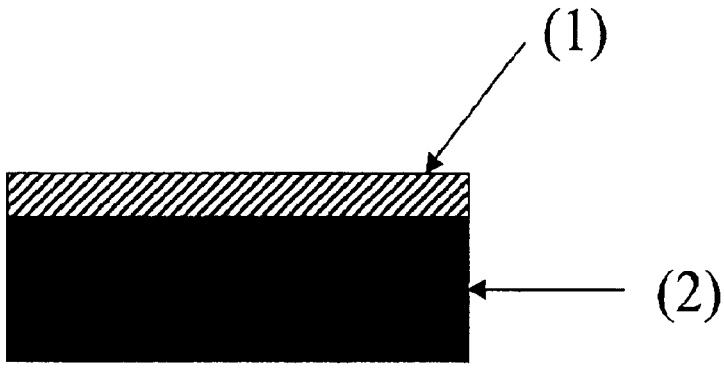
FIG. 1A is a schematic cross-sectional view of an ink-jet recording medium containing a substrate and a single ink-receptive layer.

In one embodiment of this invention, a hot-melt extrudable ink-receptive composition comprising a blend of a melt-extrudable polyvinyl alcohol composition and a compound selected from the group consisting of poly(2-ethyl-2-oxazoline), a hydrolyzed copolymer of ethylene and vinyl acetate, ethylene/acrylic acid copolymers and ethylene/methacrylic acid copolymers, and mixtures thereof is extruded onto the substrate. The blend comprises about 50% to about 95% by weight of the polyvinyl alcohol composition and about 5% to about 50% by weight of the other compound (poly(2-ethyl-2-oxazoline), a hydrolyzed copolymer of ethylene and vinyl acetate, ethylene/acrylic acid copolymers and/or ethylene/methacrylic acid copolymers) based on total weight of the blend. As shown in FIG. 1A, this extrudable composition can be used to form an ink-jet recording medium having a single ink-receptive layer (1) on substrate (2). Typically, the thickness of the ink-receptive layer is in the range of about 5 $\mu$m (0.2 mil) to about 125 $\mu$m (5 mil) and more preferably about 10 $\mu$m (0.4 mil) to about 50 $\mu$m (2 mil).

Melt-extrudable polyvinyl alcohol compositions are known in the art and are described in Famili et al., U.S. Pat. No. 5,369,168, Robeson et al., U.S. Pat. No. 5,349,000, Famili et al., U.S. Pat. No. 5,206,278, and Marten et al., U.S. Pat. No. 5,051,222, the disclosures of which are hereby incorporated by reference. The melt-extrudable polyvinyl alcohol compositions are about 78 to about 100 wt. % hydrolyzed, preferably 85–99 mol % hydrolyzed, and possess a degree of polymerization (DPn) in the range of about 200 to about 2500. The melt-extrudable compositions include chemically modified polyvinyl alcohols and polyvinyl alcohol copolymers. For example, a melt-extrudable polyvinyl alcohol copolymer containing 94 to 98 mol % vinyl alcohol and 2 to 6 mol % of a copolymerized monomer such as methyl methacrylate can be used. For example, a melt-extrudable chemically modified polyvinyl alcohol containing 1 to 30 wt. % of a polyhydric alcohol plasticizer such as glycerol or polyethylene glycol; a mineral acid such as phosphoric acid; and 0.05 to 1.0 wt. % of a dispersing agent such as glycerol mono-oleate can be used. The melt-extrudable polyvinyl alcohol compositions have a lower degree of crystallinity in their structures versus polyvinyl alcohol compositions that are not melt-extrudable. Generally, the melt-extrudable polyvinyl alcohol compositions are commercially available. For example, VINEX 2025 and VINEX 2144, available from Texas Polymer Services, Inc. (Houston, Tex.), and ALCOTEX 864, available from Harlow Chemical Company, Ltd. (Harlow, Essex, UK) are suitable.

It is important that the melt-extrudable polyvinyl alcohol composition be blended with a compound selected from the group consisting of poly(2-ethyl-2-oxazoline), a hydrolyzed copolymer of ethylene and vinyl acetate, ethylene/acrylic acid copolymers and ethylene/methacrylic acid copolymers. As shown in the following examples, it has been found that such blends may be melt-extruded onto a substrate to form an aqueous ink-jet recording medium that is capable of forming high-quality, multicolored images. Particularly, the inkjet recording media of this invention form multicolored images of similar quality to conventional ink-jet recording media that are made by solution-coating an ink-receptive coating solution onto a substrate.

In practice, the melt-extrudable ink-receptive composition may further comprise water-soluble polymers having a melting point temperature less than their degradation temperature (i.e., temperature at which the polymer degrades.). These polymers tend to swell upon exposure to the aqueous ink. Suitable water-soluble polymers include, for example, poly(ethylene oxide), poly(ethylene glycol), poly(propylene oxide), poly(propylene glycol), poly(tetrahydrofuran), and polyvinylmethylether.

In addition, the melt-extrudable ink-receptive composition may also contain water-insoluble polymers having a melting point temperature less than their degradation temperature. These polymer tend not to swell upon exposure to the aqueous ink. Suitable water-insoluble polymers include, for example, homopolymers and copolymers of polyolefins; such as, polyethylene, polypropylene, polybutylene, polyethylpentene, polyphenylene ether/oxide resins, ethylene-acrylic acid copolymer; ethylene-vinyl acetate copolymer; ethylene-acrylic acid-methacrylate terpolymer; sodium-ethylene-acrylic acid; zinc-ethylene-acrylic acid; ethylene-acrylate copolymer; ethylene-ethyl acrylate copolymer; ethylene-butyl acrylate copolymer; ethylene-methacrylate copolymer; acrylonitrile copolymers; acrylic copolymer; vinyl pyrrolidone copolymer; polyamides and copolymers; cellulose ester; polyester; polyurethane; fluoropolymers; polycarbonate; polyaryletherketone; polyetherketone; polyetherimide; polyethersulfone; and homopolymers and copolymers of polystyrene.

In addition, the melt-extrudable composition may contain various particulate (i.e., pigments) and other additives. Particulate may be used to provide the medium with anti-blocking properties to prevent ink from transferring from one medium to an adjacent medium during imaging of the media. Examples of inorganic and organic particulate include silica, alumina, alumina hydrate, pseudoboehmite, zinc oxide, tin oxide, silica-magnesia, bentonite, hectorite, titanium dioxide, poly(methyl methacrylate), and poly (tetrafluoroethylene). Typical additives include antioxidants, process stabilizers, UV absorbents, UV stabilizers, antistatic agents, anti-blocking agents, slip agents, colorants, foaming agents, plasticizers, optical brightening agents, flow agents, and the like. Anti-oxidants are particularly effective in preventing the melt-extrudable composition from discoloring.

In another embodiment of this invention, two hot-melt extrudable ink-receptive compositions are formed and co-extruded onto the substrate to form a multi-layered structure. For example, a coating formulation (i.e., intercoat or underlayer) comprising a blend of the melt-extrudable polyvinyl alcohol composition and a compound selected from the group consisting of poly(2-ethyl-2-oxazoline), a hydrolyzed copolymer of ethylene and vinyl acetate, ethylene/acrylic acid copolymers, and ethylene/methacrylic acid copolymers, as described above, may be extruded onto the substrate to form a first ink-receptive layer. The blend may comprise about 50% to about 95% by weight of the polyvinyl alcohol composition and about 5% to about 50% by weight of the other above-described compounds.

A second coating formulation (i.e., top coat) may be co-extruded over the first ink-receptive layer to form a second ink-receptive layer. The top coat may contain different ingredients or the same blend of ingredients as used in the intercoat. For example, in one embodiment, the underlayer may comprise 50% of the melt-extrudable polyvinyl alcohol composition and 50% ethylene/acrylic acid copolymer, while the top layer may comprise 50% polyvinyl alcohol composition and 50% poly(2-ethyl-2-oxazoline). If the same blend of ingredients are used in the underlayer and top layer, then the weight percentage ratio of ingredients in each respective layer is different. In this manner, the underlayer and top layer are distinguishable. For example, in another embodiment, the underlayer comprises 80% of the melt-extrudable polyvinyl alcohol composition and 20% of the hydrolyzed copolymer of ethylene and vinyl acetate, while the top layer comprises 50% of the same polyvinyl alcohol composition and 50% of the same copolymer of ethylene and vinyl acetate.

Figure 1B:
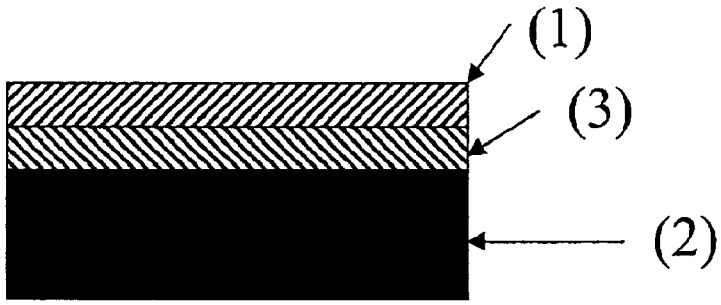
FIG. 1B is a schematic cross-sectional view of an ink-jet recording medium containing a substrate and two ink-receptive layers.

Both melt-extrudable ink-receptive compositions may contain other water-soluble and water-insoluble polymers, particulate, and additives as described above. As shown in FIG. 1B, these extrudable ink-receptive coatings can be used to form an ink-jet recording medium having multiple ink-receptive layers (1) and (3).

As discussed above, in some instances, when a large volume of ink is imparted onto a paper substrate, the aqueous ink vehicle may penetrate into the paper causing it to cockle. Accordingly, some paper substrate manufacturers treat the substrate with a moisture-barrier coating, e.g., polyethylene-coated paper substrates. Other less expensive paper substrates, e.g., clay-coated papers, do not have a moisture-barrier coating.

Figure 2A:
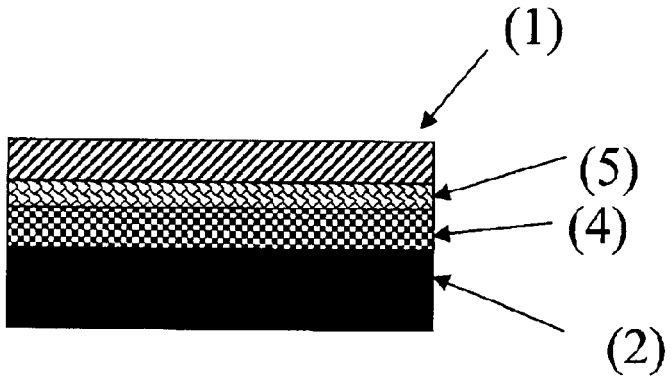
FIG. 2A is a schematic cross-sectional view of an inkjet recording medium containing a substrate, a moisture-barrier layer, a tie layer, and one ink-receptive layer.
Figure 2B:
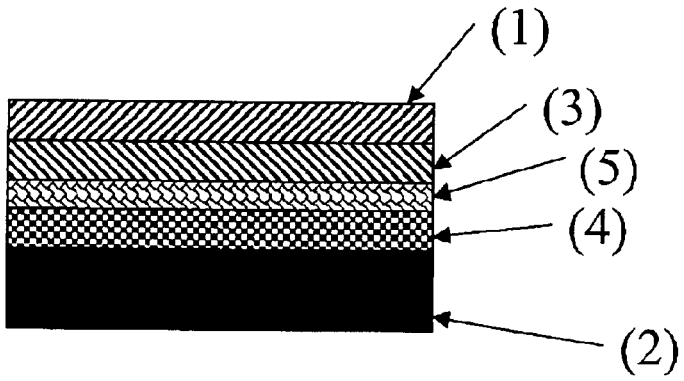
FIG. 2B is a schematic cross-sectional view of an ink-jet recording medium containing a substrate, a moisture-barrier layer, a tie layer, and two ink-receptive layers.

In the present invention, in order to prevent cockling, a moisture barrier coating should be co-extruded onto paper substrates that do not already possess a moisture-barrier coating. As shown in FIGS. 2A and 2B, moisture barrier layer (4) is extruded onto the substrate, and ink-receptive layers (1) and (3) are extruded onto the moisture barrier layer to form a multi-layered structure.

A hot-melt extrudable composition comprising a polymeric resin is used to form the moisture barrier coating. Suitable polymeric resins include, for example, homopolymers and copolymers of polyolefins, such as polyethylene and polypropylene; ethylene-acrylic acid copolymers; ethylene-acrylate copolymers; and polyesters. The moisture barrier coating may further comprise additives and particulate such as titanium dioxide, talc, calcium carbonate, silica, clay, and the like. Typically, the thickness of the moisture barrier layer is in the range of about 5 $\mu$m (0.2 mil) to about 100 $\mu$m (4 mil) and more preferably about 15 $\mu$m (0.6 mil) to about 50 $\mu$m (2 mil).

In order to increase adhesion between the ink-receptive layer(s) and moisture barrier layer, a relatively thin "binder layer" or "tie layer" may be melt-extruded onto the substrate between the ink-receptive layer(s) and moisture barrier layer. As shown in FIGS. 2A and 2B, moisture barrier layer (4) is extruded onto the substrate (2), tie layer (5) is extruded onto the barrier layer, and ink-receptive layers (1) and (3) are extruded onto the tie layer to form a multi-layered structure.

A hot-melt extrudable composition comprising a polymeric resin is used to form the tie layer. Suitable polymers include, for example, polyurethane, ethylene-acrylic acid copolymer, ethylene-methacrylic acid copolymer, ethylene-acrylic acid-methacrylate terpolymer, sodium-ethylene-acrylic acid, zinc-ethylene-acrylic acid, poly(2-ethyl-2-oxazoline), and copolymers and mixtures thereof.

Conventional hot-melt extrusion coating techniques may be used in accordance with this invention. In such processes, a resin is first subjected to heat and pressure inside the barrel of an extruder. Then, the molten resin is forced by an extruder screw through a narrow slit of an extrusion coating die. At the exit of the die slit, a molten curtain emerges. This molten curtain is drawn down from the die into a nip between two counter-rotating rolls, a chill roll, and pressure roll. While coming into contact with the faster moving substrate on the pressure roll, hot film is drawn out to the desired thickness on the substrate. The coated substrate then passes between a chill roll and pressure roll that press the coating onto the substrate to ensure complete contact and adhesion. The combination of the extruder screw speed and web line speed determines the thickness of the extrusion coatings. In a co-extrusion system, different types of molten resins from two or more extruders combine in a co-extrusion feedblock to form a multi-layered structure. This multi-layered "sandwich" is then introduced into the die and will flow across the full width of the die. With co-extrusion, a multi-layered coating can be produced in a single pass of the substrate.

Laminated Media Structures

The discovery of ink jet media that have ink receptive layers containing thermoplastic polyvinyl alcohol compositions is described in the foregoing section. This discovery is employed in the invention of new media structures that use both the thermoplastic and ink jet receptive characteristics of these media. These structures and the processes by which they are formed and used are the inventions described below.

In one type of embodiment described by a number of examples, an image layer of the invention is printed with an ink jet printer and then it is combined to form a novel laminated structure by a process that does not require the use of a special laminating component. Moreover, the laminated media and the processes leading to them have unique properties that depend on the new ink jet receptive media. In this type of embodiment, the invention involves imaging a sheet of the new media and then laminating it to another substrate, that does not have to be specially treated for the lamination.

In one specific embodiment of this invention, the imaged media is a transparent substrate coated with an ink receptive layer according to this invention and the second substrate is a sheet of ordinary paper. The novel product is formed by the face to face" combination of these two materials and is an ink jet image in a layer that serves to join the two materials. It is physically a piece of paper with a tough, transparent surface that looks like a photograph whose image is between the paper and the transparent material. It can look like a glossy or a matte style photograph, depending on the surface roughness of the non imaged side of the transparent material. In another specific embodiment, the piece of paper is replaced as the second substrate by a piece of cardboard or analogous surface of a container to be labeled or otherwise have an added display. The container can be wood, composite, metal, plastic, cloth, or other material.

In another specific embodiment, the invented media structure is formed in a similar manner, but the second substrate also is a medium of this invention. In this case, the object is substantially transparent with the image in the receptive layer, the image is protected by the non ink receptively coated surfaces of the material, and the image is enhanced by the ink receptive capacity of the second transparent medium of this invention. Still another specific embodiment is similar to the previous one except that the second substrate is an opaque substrate of the invention. In this case, the new imaged media structure has an opaque side and a transparent one. Clearly, the degree of opacity is variable within this invention.

In a second type of embodiment, the media structure can serve as a universal laminating sheet without being imaged. This provides the advantage that only this media structure, rather than both an ink receptive media and a coated laminating sheet, would needed to be stocked by end users. This would represent an economically valuable advantage to the end user, and impart value to the product that represents an improvement over the prior art.

Additional embodiments of this invention include each of these media and media structures with the addition of one or more constituents to achieve improved properties. These improvements include: increased stability in the presence of ultraviolet light; enhanced utilization of light by fluorescence (including optical brightening) or other optical processes; and, enhanced stability against oxidation. In addition, further embodiments are found to impart the ability of the media and media structures to provide enhanced security or to store personal or process information by optical, thermal, mechanical, or magnetic means. Moreover, additional embodiments include additives that impart the ability to modify the adhesion, bond development, thermal stability, film integrity, frictional coefficient, dry time, ink capacity, bleed, coverage, spreading, and similar properties. For example, the integrity and swellability, as defined in the foregoing Sargeant et al., U.S. Pat. No. 5,700,582, are controlled by addition of components to the ink receptive layer within the scope of this invention.

Further embodiments include the processes by which the novel composite media are formed, the machines to form them, and the design parameters within which the invention can be practiced. Thus, for example, it is within the scope of the invention to employ transparent substrates with thickness ranging from about 10 to about 1000 micrometers. It also is within the scope of the invention to use transparent substrates comprising polyesters, polyolefins (including metallocenes, single site catalyzed, or analogous forms), ionomers, polycarbonates, polyvinyl compounds, vinyl containing polymers, acetates, acetyls, polyurethanes, polyureas, polyamides, polystyrenes, cellulosics, polyacrylics, and blends or compounds containing them or based on their precursors.

The present invention is further illustrated by the following examples, but these examples should not be construed as limiting the scope of the invention. Ink-jet recording media samples, as prepared in the following Examples, were tested and evaluated using the below test methods.

Test Methods

Color Gamut

Ink-jet recording media samples were imaged (printed) using a Hewlett Packard DESKJET Printer 870C. The printed samples were then stored at room temperature for 24 hours. The color gamut of each sample was then measured with a X-RITE 918 Tristimulus Reflection Colorimeter (available from X-Rite, Inc.) using standard procedures described in the instrument manual provided by the manufacturer. Generally, imaged media having higher color gamut values provide images of higher color quality.

Optical Density

Ink-jet recording media samples were imaged (printed) using a Hewlett Packard DESKJET Printer 870C. The printed samples were then stored at room temperature for 24 hours. Subsequently, the optical density of black ink for each sample was measured with a X-Rite 408 Reflection Densitometer (available from X-Rite, Inc.) using standard procedures described in the instrument manual provided by the manufacturer. Generally, imaged media having higher optical density provide images of higher color quality and resolution.

EXAMPLES

Example 1

An ink-receptive composition was prepared according to the following formulation:

| | |
|---|---|
| AQUAZOL-500[1] | 50 wt. % |
| EVAL LC-E105A[2] | 50 wt. % |

[1]Poly (2-ethyl-2-oxazoline), available from Polymer Chemistry Innovations.
[2]A hydrolyzed copolymer of ethylene and vinyl acetate, available from EVAL Company of America.

First, the above-described solid resins were dried in a vacuum oven at 40° C. for about 30 hours to eliminate moisture. The resins were then dry-mixed in a blender, and the resin mixture was compounded into pellets. The resin pellets were fed into a twin-screw extruder, melted at about 210° C., mixed thoroughly, and finally extruded as several strips onto an air-cooled moving belt. At the end of the moving belt, the solidified strips were fed through a pelletizer. The resulting resin pellets were dried in a vacuum oven at about 40° C. for about six (6) hours to eliminate moisture. The resin pellets were then fed through a melt-extrusion coating line.

A melt-extrusion coating line equipped with a 3.5" single screw extruder, a T-slot die, a rubber covered pressure roll, a water-cooled chill roll, a stripper roll, unwind splicer, winder, and/or corona treater was used. The temperature inside of the extruder was controlled at about 210 to 220° C. to melt the resin pellets and form an extrudable composition. At a line speed of 300 feet per minute (fpm) and a screw speed of 14 rotations per minute (rpm), the composition was extruded onto a substrate to form an ink-jet recording medium. A "H.D. 6.0 mil white gloss polyethylene-coated paper", available from Jen-Coat Inc. (Westfield, Mass.), and primed with SANCURE 1301 (polyurethane emulsion, available from B. F. Goodrich) was used as the substrate. The thickness of the coating was about 0.5 mil.

Example 2

An ink-receptive composition was prepared according to the following formulation:

| | |
|---|---|
| PRIMACOR 3460[3] | 10 wt. % |
| VINEX 2025[4] | 90 wt. % |

[3]A copolymer of ethylene and acrylic acid, available from Dow Plastics.
[4]A partially hydrolyzed polyvinyl alcohol copolymer, available from Texas Polymer Services, Inc.

The above-described resins were mixed together and dried in a conventional oven at about 45° C. for about six (6) hours and compounded into pellets. From the pellets, a hot-melt extrudable composition was formed and extruded onto a substrate using the procedures described above in Example 1. A "H.D. 6.0 mil white gloss polyethylene-coated paper", available from Jen-Coat Inc. (Westfield, Mass.), and primed with SANCURE 1301 (polyurethane emulsion, available from B. F. Goodrich) was used as the substrate. The thickness of the coating was about 0.5 mil.

Example 3

An ink-receptive composition was prepared according to the following formulation:

| | |
|---|---|
| EVAL LC-E105A[2] | 5 wt. % |
| VINEX 2025[4] | 95 wt. % |

The above-described resins were mixed together and dried in a conventional oven at about 45° C. for about six (6) hours and compounded into pellets. From the pellets, a hot-melt extrudable composition was formed and extruded onto a substrate using the procedures described above in Example 1. A "H.D. 6.0 mil white gloss polyethylene-coated paper", available from Jen-Coat Inc. (Westfield, Mass.), and primed with SANCURE 1301 (polyurethane emulsion, available from B. F. Goodrich) was used as the substrate. The thickness of the coating was about 0.5 mil.

Example 4

An ink-receptive composition was prepared according to the following formulation:

| | |
|---|---|
| CONPOL 13B[5] | 10 wt. % |
| VINEX 2025[4] | 90 wt. % |

[5]An ethylene-methacrylic acid copolymer, available from DuPont.

The above-described resins were mixed together and dried in a conventional oven at about 45° C. for about six (6) hours and compounded into pellets. From the pellets, a hot-melt extrudable composition was formed and extruded onto a substrate using the procedures described above in Example 1. A "H.D. 6.0 mil white gloss polyethylene-coated paper", available from Jen-Coat Inc. (Westfield, Mass.), and primed with SANCURE 1301 (polyurethane emulsion, available from B. F. Goodrich) was used as the substrate. The thickness of the coating was about 0.5 mil.

Example 5

An ink-receptive composition was prepared according to the following formulation:

| | |
|---|---|
| AQUAZOL-500[1] | 5 wt. % |
| EVAL LC-L101A[6] | 10 wt. % |
| VINEX 2025[4] | 85 wt. % |

[6]A hydrolyzed copolymer of ethylene and vinyl acetate, available from EVAL Company of America.

The above-described AQUAZOL-500 resin was dried in a vacuum oven at about 40° C. for about 30 hours, mixed with the other above-described resins, and the mixture was compounded into pellets. From the pellets, a hot-melt extrudable composition was formed and extruded onto a substrate using the procedures described above in Example 1. A "H.D. 6.0 mil white gloss polyethylene-coated paper", available from Jen-Coat Inc. (Westfield, Mass.), and primed with SANCURE 1301 (polyurethane emulsion, available from B. F. Goodrich) was used as the substrate. The thickness of the coating was about 0.5 mil.

Example 6

An ink-receptive composition was prepared according to the following formulation:

| | |
|---|---|
| AQUAZOL-500[1] | 5 wt. % |
| PRIMACOR-3460[3] | 10 wt. % |
| VINEX 2025[4] | 85 wt. % |

The above-described AQUAZOL-500 resin was dried in a vacuum oven at about 40° C. for about 30 hours, mixed with the other above-described resins, and the mixture was compounded into pellets. From the pellets, a hot-melt extrudable composition was formed and extruded onto a substrate using the procedures described above in Example 1. A "H.D. 6.0 mil white gloss polyethylene-coated paper", available from Jen-Coat Inc. (Westfield, Mass.), and primed with SANCURE 1301 (polyurethane emulsion, available from B. F. Goodrich) was used as the substrate. The thickness of the coating was about 0.5 mil.

Example 7

An ink-receptive composition was prepared according to the following formulation:

| | |
|---|---|
| AQUAZOL-500[1] | 5 wt. % |
| CONPOL-13B[5] | 10 wt. % |
| VINEX 2025[4] | 85 wt. % |

The above-described AQUAZOL-500 resin was dried in a vacuum oven at about 40° C. for about 30 hours, mixed with the other above-described resins, and the mixture was compounded into pellets. From the pellets, a hot-melt extrudable composition was formed and extruded onto a substrate using the procedures described above in Example 1. A "H.D. 6.0 mil white gloss polyethylene-coated paper", available from Jen-Coat Inc. (Westfield, Mass.), and primed with SANCURE 1301 (polyurethane emulsion, available from B. F. Goodrich) was used as the substrate. The thickness of the coating was about 0.5 mil.

Example 8

Compositions were prepared according to the following formulations:

| | |
|---|---|
| Ink Receptive Layer | |
| EVAL LC-L101A[6] | 15 wt. % |
| VINEX 2025[4] | 85 wt. % |
| Tie Layer | |
| EVAL LC-L101A[6] | 100 wt. % |
| Moisture Barrier Layer | |
| Dow LDPE 4012[7] | 100 wt. % |

[7]A low density polyethylene, available from Dow Plastics.

A co-extrusion coating line was used in this Example. The co-extrusion coating line was similar to the extrusion line described in Example 1, except that two other extruders and a feedblock were included into the line. For the ink receptive layer, a mixture of the above-described resins was compounded into pellets and fed into the primary extruder and melted at a temperature of about 215° C. to form an extrudable composition. For the tie layer, EVAL LC-L101A was fed into the secondary extruder and melted at a temperature of about 215° C. to form an extrudable composition. For the moisture barrier layer, Dow LDPE-4012 was fed into the third extruder and melted at a temperature of about 250° C. to form an extrudable composition.

A melt-extrusion coating line equipped with a 3.5" single screw extruder, a T-slot die, a rubber covered pressure roll, a water-cooled chill roll, a stripper roll, unwind splicer, winder, and/or corona treater was used. At a line speed of 300 feet per minute (fpm) and a screw speed of 14 rotations per minute (rpm), the compositions were co-extruded onto a substrate to form an ink-jet recording medium. A 86# Polyjet base clay-coated paper, available from P. H. Glatfelter Inc., was used as the substrate. The thickness of each layer was about 0.5 mil. An on-line corona treater and ozone treating machine were needed to increase the adhesion of the barrier layer to the paper substrate.

Example 9

Compositions were prepared according to the following formulations:

| | |
|---|---|
| Top Layer (Ink Receptive Coating) | |
| EVAL LC-E105[2] | 20 wt. % |
| VINEX 2025[4] | 80 wt. % |
| Underlayer (Ink Receptive Coating) | |
| EVAL LC-E105[2] | 50 wt. % |
| VINEX 2025[4] | 50 wt. % |
| Moisture Barrier Layer | |
| Dow LDPE 4012[7] | 100 wt. % |

A co-extrusion coating line was used in this Example. The co-extrusion coating line was similar to the extrusion line described in Example 8. For the ink receptive top layer, a mixture of the above-described resins was compounded into pellets and fed into the primary extruder and melted at a temperature of about 215° C. to form an extrudable composition. For the ink receptive under layer, a mixture of the above-described resins was fed into the secondary extruder and melted at a temperature of about 215° C. to form an extrudable composition. For the moisture barrier layer, Dow LDPE-4012 was fed into the third extruder and melted at a temperature of about 250° C. to form an extrudable composition.

A melt-extrusion coating line equipped with a 3.5" single screw extruder, a T-slot die, a rubber covered pressure roll, a water-cooled chill roll, a stripper roll, unwind splicer, winder, and/or corona treater was used. At a line speed of 300 feet per minute (fpm) and a screw speed of 14 rotations per minute (rpm), the compositions were co-extruded as separate layers onto a substrate to form an ink-jet recording medium. A 86# Polyjet base clay-coated paper, available from P. H. Glatfelter Inc., was used as the substrate. The thickness of each layer was about 0.5 mil. An on-line corona treater and ozone treating machine were needed to increase the adhesion of barrier layer to the paper substrate.

Comparative Example A

Commercially-available ink-jet receiving sheets (Arkwright Ink-Jet Universal Glossy Paper 8.5×11, Lot Number X07360301, available from Arkwright Incorporated) were used in this Example. These sheets are produced by coating solutions containing polymers and additives in a carrier fluid onto a polyethylene-coated paper using a rod-coating method.

Comparative Example B

Commercially-available ink-jet receiving sheets (Arkwright Ink-jet Glossy White Film 8.5×11, Lot Number X07343701, available from Arkwright Incorporated) were used in this Example. These sheets are produced by coating solutions containing polymers and additives in a carrier fluid onto a polyester white film using a rod-coating method.

The above-described ink-jet recording media samples were tested for color gamut and optical density using the foregoing test methods, and the results are reported below in Table I.

TABLE I

Comparative Testing Results

| Receiving Sheet | Color Gamut | Optical Density |
|---|---|---|
| Example 1 | 2389 | 1.94 |
| Example 2 | 2405 | 1.82 |
| Example 3 | 2507 | 2.10 |
| Example 4 | 2729 | 1.70 |
| Example 5 | 2517 | 2.10 |
| Example 6 | 2771 | 1.90 |
| Example 7 | 2742 | 1.70 |
| Example 8 | 2028 | 2.30 |
| Example 9 | 2323 | 1.95 |
| Comp. Example A | 2114 | 1.82 |
| Comp. Example B | 2031 | 1.84 |

As shown in above Table 1, ink-jet recording media produced in accordance with methods of the present invention can record images having good color gamut and optical density (Examples 1–9). The printed images on the media in Examples 1–9 have a similar color quality to printed images on media samples produced by conventional solution-coating methods (Comparative Examples A and B).

In the following Examples 10–19, laminated media structures are described.

Example 10

Coating compositions were prepared according to the following formulation:

| Primer Coating | |
|---|---|
| Water | 30.55 wt. % |
| SANCURE 1301[1] | 49.50 wt. % |
| Methanol | 19.80 wt. % |
| METHOCEL K3 Premium[2] | 0.15 wt. % |
| Surface Coating (Top Layer) | |
| Water | 80 wt. % |
| VINEX 2025[3] | 20 wt. % |

[1]Waterborne urethane polymer, BFGoodrich.
[2]Hydroxypropyl Methylcellulose, The Dow Chemical Company.
[3]A partially hydrolyzed polyvinyl alcohol copolymer, available from Texas Polymer Services, Inc.

The primer coating was applied to a transparent polyester film (ICI Films) using a Meyer coating rod. After drying the primer at about 120° C. for about 2 minutes, the surface coating was applied over the primer using a Meyer coating rod. Then, the coatings were dried at about 120° C. for about 3 minutes. The coated polyester film was cut into 8.5"×11" sheets (Samples-A). A coated 8.5"×11" sheet (Sample-A) was printed (imaged) on a Hewlett Packard DESKJET Printer 850C and stored at room temperature for 24 hours to produce an imaged sheet (Sample-B). A non-imaged 8.5"×11" sheet (Sample-A) was face-to-face laminated with an imaged 8.5"×11" sheet (Sample-B) through a ThermoBlitz Bonding machine at the setting of High Temperature". The image of the imaged product was of good quality, and its outside surfaces had the properties of the original uncoated polyester film.

Example 11

Coating compositions were prepared according to the following formulations:

| Primer Coating | |
|---|---|
| Water | 30.55 wt. % |
| SANCURE 1301 | 49.50 wt. % |
| Methanol | 19.80 wt. % |
| METHOCEL K3 Premium | 0.15 wt. % |
| Surface Coating (Top Layer) | |
| Water | 78.4 wt. % |
| VINEX 2025 | 19.6 wt. % |
| TINUVIN 1130[1] | 2 wt. % |

[1]UV absorber, Ciba Specialty Chemicals Corporation, Tarrytown, NY 10591.

The primer coating was applied to a transparent polyester film (ICI Films) using a Meyer coating rod. After drying the primer at about 120° C. for about 2 minutes, the surface coating was applied over the primer using a Meyer coating rod. Then, the coatings were dried at about 120° C. for about 3 minutes. The coated polyester film was cut into 8.5"×11" sheets. A coated 8.5"×11" sheet was printed on a Hewlett Packard DESKJET Printer 850C and stored at room temperature for 24 hours (Sample-C). A non-imaged 8.5"×11" coated sheet from Example 10 (Sample-A) was face-to-face laminated with an imaged 8.5"×11" sheet (Sample-C) through a ThermoBlitz Bonding machine at the setting of High Temperature". The image of the imaged product was of good quality, and its outside surfaces had the properties of the original uncoated polyester film.

Example 12

Coating compositions were prepared according to the following formulations:

| Primer Coating | |
|---|---|
| Water | 30.55 wt. % |
| SANCURE 1301 | 49.50 wt. % |
| Methanol | 19.80 wt. % |
| METHOCEL K3 Premium | 0.15 wt. % |
| Surface Coating (Top Layer) | |
| Water | 79.2 wt. % |
| VINEX 2025 | 19.8 wt. % |
| TINOPAL SFP[1] | 1 wt. % |

[1]Optical brightener, Ciba Specialty Chemicals Corporation, Tarrytown, NY 10591.

The primer coating was applied to a transparent polyester film (ICI Films) using a Meyer coating rod. After drying the primer at about 120° C. for about 2 minutes, the surface coating layer was applied using a Meyer coating rod. Then, the coatings were dried at about 120° C. for about 3 minutes. The coated polyester film was cut into 8.5"×11" sheets. A coated 8.5"×11" sheet was printed on a Hewlett Packard DESKJET Printer 850C and stored at room temperature for 24 hours (Sample-D). A non-imaged 8.5"×11" coated sheet from Example 10 (Sample-A) was face-to-face laminated with an imaged 8.5"×11" sheet (Sample-D) through a ThermoBlitz Bonding machine at the setting of High Temperature". The image of the imaged product was of good quality, and its outside surfaces had the properties of the original uncoated polyester film.

Example 13

The coated 8.5"×11" sheet from Example 10 (Sample A) was selectively printed with yellow color on a Hewlett Packard DESKJET Printer 850C and stored at room temperature for 24 hours (Sample-E). A non-imaged 8.5"×11" coated sheet from Example 10 (Sample-A) was face-to-face laminated with an imaged 8.5"×11" sheet (Sample-E) through a ThermoBlitz Bonding machine at the setting of High Temperature". The image of the imaged product was of good quality, and its outside surfaces had the properties of the original uncoated polyester film.

Example 14

Coating compositions were prepared according to the following formulations:

| Primer Coating | |
|---|---|
| Water | 30.55 wt. % |
| SANCURE 1301 | 49.50 wt. % |
| Methanol | 19.80 wt. % |
| METHOCEL K3 Premium | 0.15 wt. % |
| Surface Coating (Top Layer) | |
| Water | 89.8 wt. % |
| VINEX 2025 | 9.95 wt. % |
| INTRACID VIOLET 4BNS EXC[1] | 0.25 wt. % |

[1]Triphenylmethane dye, Crompton & Knowles Colors Inc., Reading, PA 19603.

The primer coating was applied to a transparent polyester film (ICI Films) using a Meyer coating rod. After drying the primer at about 120° C. for about 2 minutes, the surface coating was applied using a Meyer coating rod. Then, the coatings were dried at about 120° C. for about 3 minutes. The coated polyester film was cut into 8.5"×11" sheets (Sample-F). A non-imaged 8.5"×11" coated sheet (Sample-F) was face-to-face laminated with an imaged 8.5"×11"

sheet (Sample B) through a ThermoBlitz Bonding machine at the setting of High Temperature". The image of the imaged product was of good quality, and its outside surfaces had the properties of the original uncoated polyester film.

Example 15

A non-imaged 8.5"×11" paper was face-to-face laminated with an imaged 8.5"×11" sheet (Sample-B) through a ThermoBlitz Bonding machine at the setting of High Temperature". The image of the imaged product was of good quality, and its outside surfaces had the properties of the original uncoated polyester film.

Example 16

A H.D. 6.0 mil white gloss polyethylene-coated paper, available from Jen-Coat Inc. (Westfield, Mass.), and primed with SANCURE 1301 was used as a substrate. The VINEX 2025 was extrusion-coated onto the polyethylene-coated paper. The extrusion coated 8.5"×11" paper was printed on a Hewlett Packard DESKJET Printer 870C and stored at room temperature for 24 hours (Sample-G). A non-imaged 8.5"×11" coated sheet (Sample-A) was face-to-face laminated with an imaged 8.5"×11" paper (Sample-G) through a ThermoBlitz Bonding machine at the setting of High Temperature". The image of the imaged product was of good quality, and its outside surfaces had the properties of the original uncoated polyester film.

Example 17

A H.D. 6.0 mil white gloss polyethylene-coated paper (Jen-Coat Inc.) was used as a substrate. The primer coating of Example 10 was applied to the polyethylene-coated paper using a Meyer coating rod. After drying the primer at about 120° C. for about 2 minutes, the surface coating from Example 10 was applied using a Meyer coating rod. Then, the coatings were dried at about 120° C. for about 3 minutes. The coated 8.5"×11" paper sheet was printed on a Hewlett Packard DESKJET Printer 870C and stored at room temperature for 24 hours (Sample-H). A non-imaged 8.5"×11" coated sheet (Sample-A) was face-to-face laminated with an imaged 8.5"×11" paper sheet (Sample-H) through a ThermoBlitz Bonding machine at the setting of High Temperature". The image of the imaged product was of good quality, and its outside surfaces had the properties of the original uncoated polyester film.

Example 18

A non-imaged 8.5"×11" sheet of cardboard was face-to-face laminated with an imaged 8.5"×11" (Sample-B) sheet through a ThermoBlitz Bonding machine at the setting of High Temperature". The image, which was viewable through the imaged coated sheet, was of good quality, and one of the outer surfaces of the object had the properties of the original uncoated polyester film.

The scope of the present invention as disclosed herein is only limited by the scope of the claims appended hereto and the equivalents encompassed thereby.

What is claimed is:

1. A method for producing an ink-jet recording medium, comprising the steps of:

a) forming a hot-melt extrudable ink-receptive composition comprising a blend of about 50% to about 95% by weight of a melt-extrudable polyvinyl alcohol composition and about 5% to about 50% by weight of a compound selected from the group consisting of poly (2-ethyl-2-oxazoline), a hydrolyzed copolymer of ethylene and vinyl acetate, ethylene/acrylic acid copolymers and ethylene/methacrylic acid copolymers;

b) forming a hot-melt extrudable tie composition comprising a polymer selected from the group consisting of polyurethane, ethylene-acrylic acid copolymer, ethylene-methacrylic acid copolymer, ethylene-acrylic acid-methacrylate terpolymer, poly(2-ethyl-2-oxazoline), and copolymers and mixtures thereof;

c) forming a hot-melt extrudable moisture barrier composition comprising a polymer selected from the group consisting of polyolefins, ethylene-acrylic acid copolymer, ethylene-acrylate copolymer, and polyester, and copolymers and mixtures thereof; and d) co-extruding the ink-receptive, tie, and moisture barrier compositions onto a substrate to form an ink-jet recording medium having multiple ink-receptive layers.

2. An ink-jet recording medium produced by the method of claim 1.

* * * * *